United States Patent [19]

Imai et al.

[11] 4,308,488

[45] Dec. 29, 1981

[54] PLASMA JET IGNITION SYSTEM

[75] Inventors: Iwao Imai, Yokosuka; Yukitsugu Hirota, Yokohama, both of Japan

[73] Assignee: Nissan Motor Co., Ltd., Japan

[21] Appl. No.: 141,551

[22] Filed: Apr. 18, 1980

[30] Foreign Application Priority Data

Apr. 24, 1979 [JP] Japan ..... 54-54923[U]

[51] Int. Cl.[3] ..... F02P 3/08

[52] U.S. Cl. ..... 315/209 CD; 123/633; 123/655; 315/85; 315/201

[58] Field of Search ..... 315/58, 85, 201, 209 CD, 315/241 R; 313/134; 123/598, 605, 620, 633, 655

[56] References Cited

U.S. PATENT DOCUMENTS

| | | | |
|---|---|---|---|
| 3,788,293 | 1/1974 | Anderson | 123/620 |
| 3,919,993 | 11/1975 | Neuman | 123/620 |
| 4,122,816 | 10/1978 | Fitzgerald et al. | 123/598 |
| 4,186,712 | 2/1980 | Fitzner et al. | 123/633 |
| 4,223,656 | 9/1980 | Hamley | 315/209 CD X |

*Primary Examiner*—Eugene R. La Roche

*Attorney, Agent, or Firm*—Lane, Aitken, Kice & Kananen

[57] ABSTRACT

A plasma jet ignition system wherein a plasma jet energy storage system is designed as an add-on system, which is used in conjunction with a conventional ignition system which provides the basic spark timing and high voltage trigger signal to plasma jet ignition plugs. The plasma jet energy storage system is connected to the plasma jet ignition plugs via steering diodes. Each of the steering diodes has an anode terminal directly connected to one of the plasma jet ignition plugs.

8 Claims, 5 Drawing Figures

(A)

(B)

PLASMA JET IGNITION SYSTEM

BACKGROUND OF THE INVENTION

The present invention relates to a plasma jet ignition system and more particularly to a plasma jet ignition system for an automotive internal combustion engine.

In order to extend the lean misfire limit of the conventional spark ignition internal combustion engines, there is a continuing interest in new ignition sources and their effects on engine performance and emissions. Various kinds of new ignition systems have been proposed.

As shown in FIG. 1, a plasma jet ignition system has been proposed wherein a plasma jet energy storage system is designed as an add-on system, which is used in conjunction with a conventional ignition system which provides the basic spark timing and high voltage trigger signal to the plasma jet ignition plugs.

Referring to FIG. 1, the conventional ignition system includes a spark energy storage system 5 which has a battery 1, an ignition coil 2 having a primary winding connected to the battery via a ballast resistor $R_B$ and a secondary winding connected to a distributor 4 via a high voltage diode, and an ignition module represented schematically by a breaker 3 connected to the ignition coil 2. The distributor 4 is connected to all of a plurality plasma jet ignition plugs 7 of the engine by a spark energy delivery harness which includes a plurality of spark energy delivery cables 20 each leading to one of the plurality of plasma jet ignition plugs 7.

The plasma jet energy storage system 6 includes a high voltage power supply 8, a charging resistor 9, a storage capacitor 10, a free wheeling diode 11 which improves the efficiency of energy delivery by preventing voltage reversal on the storage capacitor 10, and an inductor or a choke coil 12 which limits peak discharge current from the capacitor 10. The storage capacitor 10, free wheeling diode 11 and inductor 12 are arranged to form an energy storage and pulse shaping network. The energy storage and pulse shaping network is connected to all of the plasma jet ignition plugs 7 by a plasma jet energy delivery harness including a plurality of plasma jet energy delivery cables 19 each leading to one of the plasma jet ignition plugs 7. Steering diodes 13 are arranged to prevent the spark energy from flowing into the storage capacitor 10. Hence, a reduction in the spark energy which might have occured is prevented by the use of these steering diodes 13.

As illustrated in FIG. 1, the plasma jet ignition plug 7 has a first or rod shaped electrode 14, a second electrode 15 and an insulating body 16 which together with the first and second electrodes 14, 15 defines a substantially enclosed plasma cavity 17. The second electrode closes one end of the plasma cavity 17 and is formed with an orifice 18 therethrough. The first rod-shaped electrode 14 extends part-way towards the second electrode 15 whereby to define a plasma cavity gap between the first and second electrodes 14, 15. The first electrode 14 is connected to the distributor 4 through the spark energy delivery cable 20 and the plasma jet energy storage system 6 through the plasma jet energy delivery cable 19, while the second electrode 15 is grounded. When sufficiently high potential is applied across the first and second electrodes 14, 15, upon opening of the breaker 3, to cause electrical breakdown of the plasma cavity gap, the energy stored on the storage capacitor 10 is now dumped into the plasma cavity gap by the discharge current. With sufficient electrical energy being supplied to the plasma cavity 17 during a sufficiently short time period, a jet of plasma is produced. A portion of the plasma within the plasma cavity 17 is ejected out of the plasma cavity through the orifice 18.

As different from the conventional electronic ignition system, the plasma jet ignition system illustrated in FIG. 1 operates as follows: When a spark occurs between the first and second electrodes 14, 15, a plasma jet is generated within the plasma cavity 17. The electrically conductive state of the plasma cavity caused by the plasma induces the discharge of electric energy stored on the storage capacitor 10 in the form of a discharge current. This discharge current causes the gaseous area of plasma to extend. This plasma consists of free electrons and ions that are at a high temperature and are therefore highly energetic and chemically active. The plasma is produced by the shock heating of the gas confined in the plasma cavity 17 by the electrical energy. This raises the temperature of the confined gas and produces partial ionization of this gas. The sudden increase in temperature also raises the instantaneous pressure of the partially confined plasma, causing a portion of it to be ejected out of the plasma cavity 17. This high temperature and high energy (capacitor 10 equal to 0.25 $\mu$F and charged to 3,000 V for a stored energy of 1.125 J) ejected gaseous flow causes the production of a great number of small-spot like flames within a combustion space, causing safe ignition of the air fuel mixture within the combustion space.

The plasma jet ignition system illustrated in FIG. 1 has a problem caused by the use of or addition of a plasma jet energy storage system in conjunction with a conventional electronic ignition system. The problem is in an increase in a capacity $C_s$ between the plasma jet energy delivery harness and the ground. This capacity $C_s$ is applied across or in parallel to the plasma cavity gap of each plasma jet plug 7. In order to produce a sufficiently strong spark across the plasma gap cavity as to induce a plasma within the plasma cavity 17, a relatively high voltage from 20 KV to 30 KV is required to be applied across the plasma gap cavity. However, if the capacity $C_s$ applied across the plasma gap cavity increases, a portion of the spark energy absorbed by this capacity $C_s$ increases as to cause the voltage across the plasma gap cavity to fail to reach the required high level, causing misfire.

Electromagnetic wave noise occurs because of transmission of high energy pulsation current through the plasma jet energy delivery harness. If shielded cables are used for the purpose of suppressing the wave noise, the quantity of capacity applied across the plasma cavity gap increases further, resulting in an increase in probability of misfire. Thus, the use of shielded cables is not practical and no practical proposal thus far has been made to suppress the wave noise.

SUMMARY OF THE INVENTION

An object of the present invention is to provide a plasma jet ignition system wherein an effect of a capacity between a plasma jet energy delivery harness and the ground upon a spark discharge energy is reduced to a sufficiently low level.

Whereby it is now possible to employ shielded cables for the plasma jet energy delivery harness for the purpose of suppressing wave noise effectively.

The invention concerns a plasma jet ignition system which comprises:

a spark energy storage system;

a plurality of plasma jet ignition plugs;

a spark energy delivery harness;

a plasma jet energy storage system;

a plasma jet energy delivery harness;

said plasma jet energy delivery harness including a plurality of steering diodes, wherein each of said steering diodes has an anode terminal directly connected to one of said plurality of plasma jet ignition plugs.

Another aspect of the invention resides in that said plasma energy delivery harness includes a plurality of shielded cables with their sheathes grounded, each of said shielded cables leading to one of said steering diodes and connecting with said one steering diode at a cathode terminal thereof.

Still another aspect of the invention resides in the arrangement wherein each plug cap for receiving a plasma jet ignition plug has embedded therein the associated one steering diode.

The invention will be hereinafter described in connection with the accompanying drawings:

DETAILED DESCRIPTION OF THE INVENTION

Figure 1:
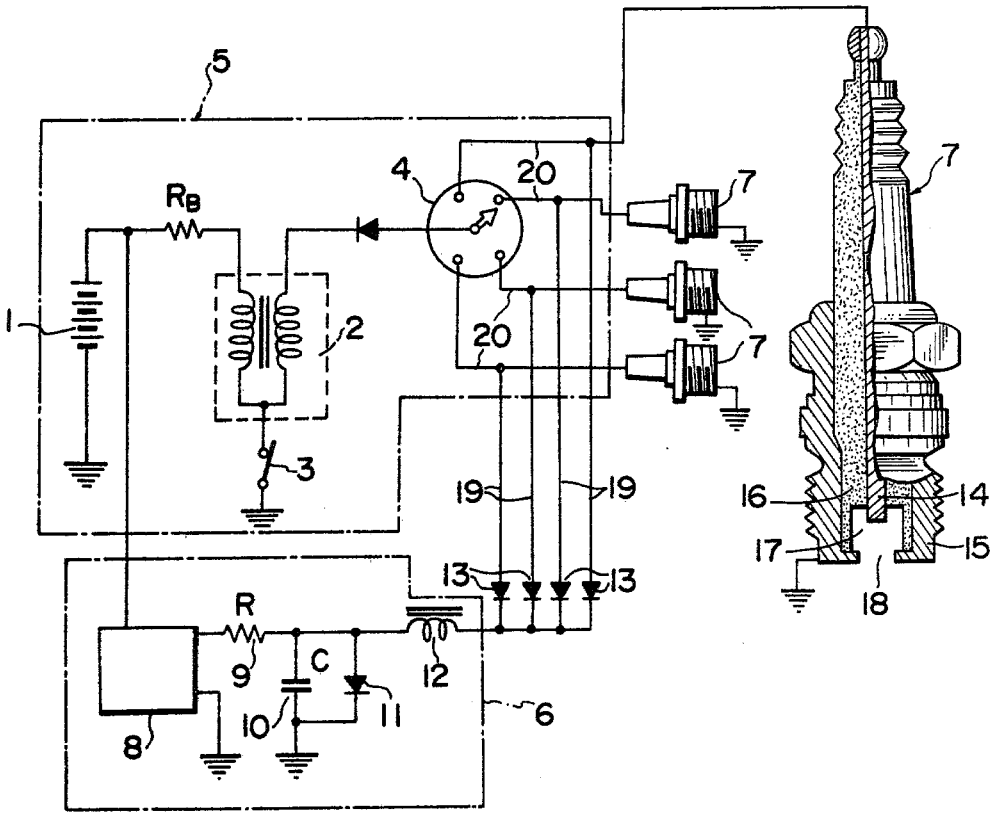
FIG. 1 is an interconnection diagram showing a plasma jet ignition system.
Figure 2:
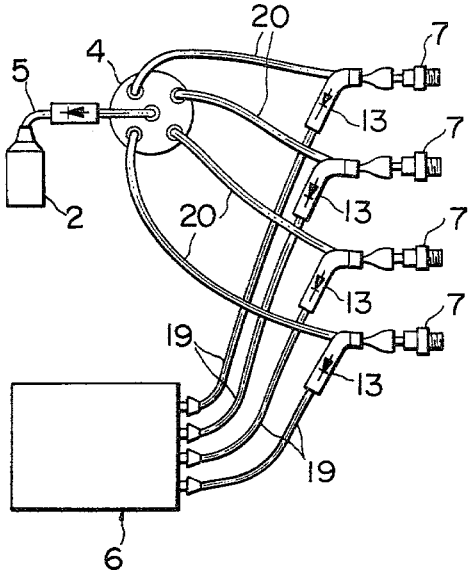
FIG. 2 is a diagram of a four cylinder plasma jet ignition system according to the invention.
Figure 3:
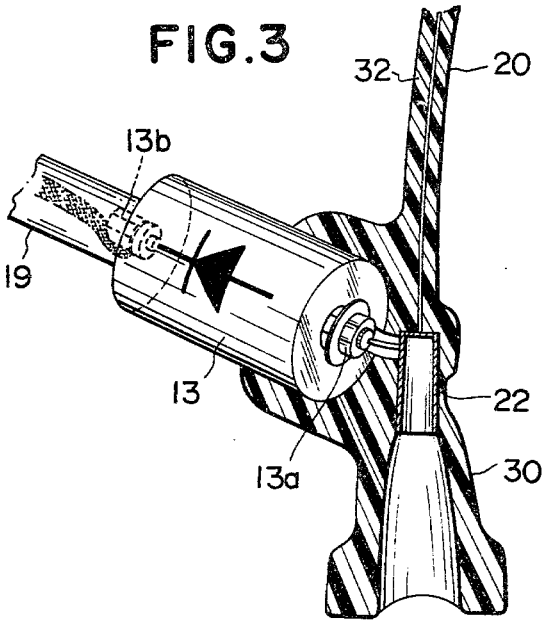
FIG. 3 is an enlarged partial view showing a connection area between a plug cap of an electrical insulator and a steering diode.

Referring to FIGS. 2 and 3, a preferred embodiment of the present invention will be hereinafter described, wherein like reference numerals which are used in FIG. 1 are to designate like parts shown in FIG. 1 for the simplicity of the description. In FIG. 2, the reference numeral 2 designates an ignition coil; 4 a distributor; the numeral 20 shows a spark energy delivery harness; the numeral 6 refers to a plasma jet energy storage system; the numeral 19 designates a plasma jet energy delivery harness; and the numeral 7 refers to the plasma jet ignition plugs of high tension resistive cables 20, each leading to one of the plasma jet ignition plugs 7 in the conventional manner.

The plasma jet energy delivery harness includes a plurality of steering diodes 13 arranged to prevent the spark energy from flowing into a storage capacitor 10 (see FIG. 1). Each of the steering diodes 13 has its anode terminal 13*a* connected to one of the plurality of plasma jet ignition plugs 7 as shown in FIG. 3.

Referring to FIG. 3, a plug cap 30 of electrically insulating material is integral with an outer sheath 32 of the high tension resistive cable 20. The plug cap 30 includes a metal connector 34 adapted to engage the plasma jet ignition plugs. The steering diode 13 has its anode terminal 13*a* connected to the metal connector 34. The plug cap 30, although it may have embedded therein the steering diode 13, conceals a connection area where the metal connector 22 is connected to the anode terminal 13*a* of the steering diode 13.

Figure 4:
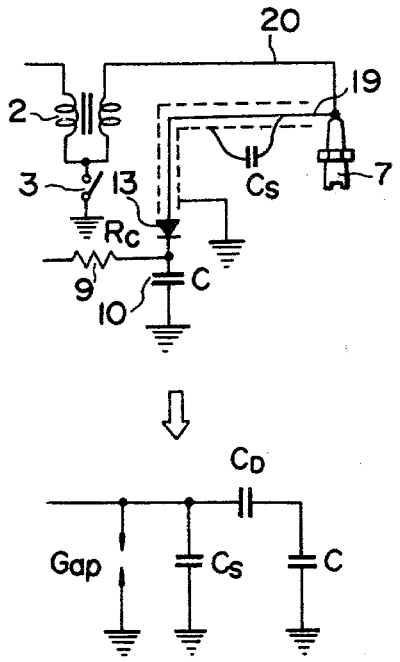
FIG. 4(A) is a circuit diagram showing part of the conventional plasma jet ignition system accompanied by an equivalent circuit.
FIG. 4(B) is a circuit diagram showing part of the plasma jet ignition system illustrated in FIG. 2 accompanied by an equivalent circuit.
Figure 4:
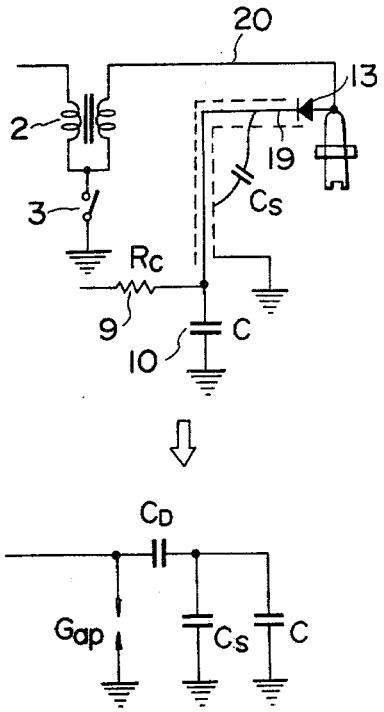

The plasma jet energy delivery harness includes a plurality of shielded cables 19 with their sheathes grounded (see FIG. 4(A)), each of the shielded cables leading to one of the steering diodes 13 at a cathode terminal 13*b* thereof. This arrangement with shielded cables 19 is effective to shield or reduce the radiation of wave noise from the plasma jet energy delivery harness.

Now referring to FIGS. 4(A) and 4(B), it will be described how differently the capacity $C_s$ of the shielded cable 19 has an influence on the generation of a spark dependent upon the location of the steering diode 13. FIG. 4(A) and 4(B) show portions of the circuits, respectively, wherein FIG. 4(A) shows the conventional circuit, while, FIG. 4(B) the circuit of the invention. In the case of FIG. 4(A), even if a negative high voltage pulse is generated across the ignition coil 2 upon opening of the breaker 3, the plasma jet plug is bypassed due to static capacity of the shielded cable 19, thus failing to provide the optimum spark. In this case, the diode 13 is inversely biased and acts as a condenser with a depletion-layer capacity $C_D$ (far smaller than $C_s$). In the case of FIG. 4(B), the diode 13 is disposed between the plasma jet ignition plug 17 and the capacity $C_s$ of the shielded cable 19 and is inversely biased, when being applied with a negative high voltage from the ignition coil 2, thereby to act as a condenser with a small capacity $C_D$. In this case, since the capacity $C_D$ is in series with $C_s$ and C, the static capacity acting in parallel to the plug 17 is greatly reduced.

It will now be understood from the preceding description that according to the present invention since the steering diodes are positioned in the proximity of the respective plasma jet ignition plugs by directly connecting their anode terminals to the plasma jet ignition plugs, respectively, a drop in supply voltage to the plasma cavity gap due to the grounding capacity of the cables can be avoided, thus assuring generation of a good ignition spark, and since ill effect caused by the shielded capacity can be reduced, shielded cables can be used to suppress radiation of wave noise.

What is claimed is:

1. A plasma jet ignition system comprising:

a spark energy storage system including an ignition coil having a primary winding and a secondary winding, an ignition module connected to said primary winding of said ignition coil, and a distributor connected to said secondary winding of said ignition coil;

a plurality of plasma jet ignition plugs;

a spark energy delivery harness connecting said plurality of plasma jet ignition plugs to said distributor;

a plasma jet energy storage system including a high voltage power source, an energy storage and pulse shaping network that includes a storage capacitor connected to said high voltage power source;

a plasma jet energy delivery harness connecting said plurality of plasma jet ignition plugs to said energy storage and pulse shaping network of said plasma jet energy storage system, said plasma jet energy delivery harness including a plurality of steering diodes arranged to prevent the spark energy from flowing into said storage capacitor, wherein each of said steering diodes has an anode terminal directly connected to one of said plurality of plasma jet ignition plugs.

2. A plasma jet ignition system as claimed in claim 1, wherein said plasma energy delivery harness includes a plurality of shielded cables with their sheathes grounded, each of said shielded cables leading to one of said steering diodes and connecting with said one steering diode at a cathode terminal thereof.

3. A plasma jet ignition system as claimed in claim 1 or 2, including a plurality of plug caps for receiving said plurality of plasma jet ignition plugs, respectively, each of said plurality of plug caps including a metal connector engaging one of said plurality of plasma jet ignition plugs, wherein each of said steering diodes has its anode terminal connected to said metal connector of one of said plurality of plug caps.

4. A plasma jet ignition system as claimed in claim 2, wherein said spark energy delivery harness includes a plurality of high tension resistive cables, each leading to one of said plurality of plasma jet ignition plugs.

5. A plasma jet ignition system as claimed in claim 3, wherein each of said plurality of plug caps has embedded therein one of said plurality of steering diodes.

6. A plasma jet ignition system as claimed in claim 3, wherein each of said plurality of plug caps conceals connection area where the metal connector of said plug cap is connected to said anode terminal of one of said steering diodes.

7. A plasma jet ignition system as claimed in claim 3, wherein said ignition module includes a breaker.

8. A plasma jet ignition system as claimed in claim 3, wherein said energy storage and pulse shaping network includes a free wheeling diode constructed and arranged as to improve the efficiency of energy delivery by preventing voltage reversal on said storage capacitor and an inductor constructed and arranged as to limit the peak value of the discharge current from said storage capacitor and to control the discharge duration.

* * * * *